US005703720A

United States Patent [19]

Fulco et al.

[11] Patent Number: 5,703,720

[45] Date of Patent: Dec. 30, 1997

[54] LIGHT COLLECTION AND DISTRIBUTION APPARATUS

[76] Inventors: Frank J. Fulco, 4814 Woodland, Western Springs, Ill. 60558; Frank J. Fulco, Jr., 1486 Monarch Cir., Naperville, Ill. 60564

[21] Appl. No.: 699,256

[22] Filed: Aug. 19, 1996

[51] Int. Cl.[6] ..... B02B 5/08

[52] U.S. Cl. ..... 359/591; 359/592; 359/593; 359/597

[58] Field of Search ..... 359/591–598

[56] References Cited

U.S. PATENT DOCUMENTS 3,246,564 4/1966 Chieffe ..... 88/59

4,921,339 5/1990 Brischke ..... 350/623

*Primary Examiner*—Safet Metjahic

*Assistant Examiner*—Daniel P. Malley

*Attorney, Agent, or Firm*—Michael R. McKenwa

[57] ABSTRACT

A light collection and distribution apparatus for use with an exterior window well comprising a window well liner having at least one primary surface which is reflective and faces the window to reflect light rays in the direction of the window, a reflective panel mounted on the building wall above the window, and other mechanisms for increasing light passage through the building wall including a transom disposed in the building wall above the window, reflective surfaces disposed on the bottom sill of the window and on the side jamb.

37 Claims, 4 Drawing Sheets

LIGHT COLLECTION AND DISTRIBUTION APPARATUS

BACKGROUND OF THE INVENTION

This invention relates to a light collection and distribution apparatus for use with an exterior window and associated well. The apparatus comprises a window well liner having at least one primary surface that is reflective and that faces generally toward the window to reflect light rays in the direction of the window.

The light collection and distribution apparatus may include a reflective panel mounted on the building wall above the window to reflect light rays away from the building wall. The first reflective panel may also be skewed relative to the building wall.

The natural light enhancing light collection and distribution apparatus may further include a pad with a generally upwardly facing reflective surface which can be arranged proximate to the bottom edge of the liner.

Moreover, a reflective framework mounted on the building wall around at least a portion of the window may be employed to reflect light rays away from the building wall.

Other means for increasing light passage through the building wall may further comprise a transom disposed in the building wall above the window that is supported by a crossbar secured to the building wall, a first reflective surface disposed on a bottom exterior sill of the window and a second reflective surface disposed on a bottom interior sill of the window arranged to reflect light rays through the window, and a plurality of reflectors, angularly adjustable to reflect light rays through the window, disposed on at least a side portion of the frame.

Alternative technology is available in the form of U.S. Pat. No. 5,467,564 which relates to a daylight collection and distribution system issued to DeKeyser et.al. in 1995 for a daylight collection and distribution system. Basically this patent discloses a skylight or a window well cover which provides a unique sunlight collection and transmitting surface. FIGS. 3, 8, 9, and 10 show a fresnel lens system employed to improve light transmission efficiency.

An older patent, U.S. Pat. No. 3,246,564, issued to Chieffe for a protective lightway for fallout shelters in 1966, comprises a light transmission area employing a number of upper panes of substantially rigid transparent material at the inlet and reflective surfaces disposed at the bottom of the light path.

U.S. Pat. No. 618,280 issued to Manning in 1899 for a window and light reflecting surface comprises an outer and lower reflecting surface and a transmission surface capable of redirecting the path of light.

Some of the drawbacks to these designs are that while each teaches a structure to enhance light direction, none of them enhances the capture of surrounding light to increase basement brightness.

To alleviate this problem, and others which will become apparent from the disclosure which follows, the present invention conveniently augment a window well associated with a below grade basement window and to redirect surrounding sunlight in the direction of and to increase light transmission through the basement window. The instant device guides surrounding sunlight from at least one reflective surface to and through the basement window.

The instant invention utilizes a number of unique reflective surfaces, adaptively positioned and angled to increase the amount of light transmitted through the window and into the basement space.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that enhance light direction generally, none of the foregoing inventions captures surrounding light to enhance basement brightness. The present invention conveniently augment a window well associated with a below grade basement window and to redirect surrounding sunlight in the direction of and to increase light transmission through the basement window. The instant device guides surrounding sunlight from at least one reflective surface through the basement window and may be angularly adjusted.

The instant apparatus includes an efficient and convenient means of augmenting the size of a standard below grade basement window by providing a transom window disposed above the standard window separated by a crossbar secured to the building wall. Moreover, in the present invention, the sill of the basement window can be augmented by reflectors which may be disposed on the outside as well as the inside of the window.

Other advantages of the present invention include reflective structures disposed on the side jambs of the windows to direct light into the basement. Additionally, this apparatus can be adapted with window adjacent reflective panels that direct light away from the building and toward the other reflective surfaces of the invention. Thus, this invention provides for the first time an integrated system of reflective elements that efficiently redirect natural light into a below grade basement space to reduce the need for supplemental lighting and attendant economic and environmental costs.

In brief, this light collection and distribution apparatus provides basement lighting naturally produced by sunlight which is redirected and facilitated by the structures incorporated herein. It will be further appreciated in the broadest application, that the invention is extremely useful in reducing the need to create additional electricity for artificial light.

Still other advantages will be apparent from the disclosure that follows.

SUMMARY OF THE INVENTION

This invention relates to a light collection and distribution apparatus for use with an exterior window well. The window well is a generally vertically disposed hollow in the ground. The window well is disposed in operative association with a building wall that has an opening with a window extending below grade supported by a frame. The apparatus of the present invention comprises a window well liner having at least one primary surface that is reflective. The at least one primary surface faces generally toward the window to reflect light rays in the direction of the window. The liner is disposed in operative association with the window well and has a bottom edge that extends below grade. The at least one primary surface may further be skewed from a vertical plane.

Additionally, a reflective panel may be mounted on the building wall above the window to reflect light rays away from the building wall and toward the other reflective surfaces of the invention. The first reflective panel may be skewed relative to the building wall. Furthermore, at least one pad may be arranged proximate to the bottom edge of the liner with at least one generally upwardly facing reflective surface.

Moreover, a reflective framework mounted on the building wall around at least a portion of the window to reflect light rays away from the building wall may be employed. Other means for increasing light passage through the building wall include a transom disposed in the building wall above the window that is supported by a crossbar secured to the building wall separating the transom from the window, a first reflective surface disposed on a bottom exterior sill of the window and a second reflective surface disposed on a bottom interior sill of the window, both arranged to reflect light rays through the window, and a plurality of reflectors arranged to reflect light rays through the window disposed on at least a side portion of the frame.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 2:
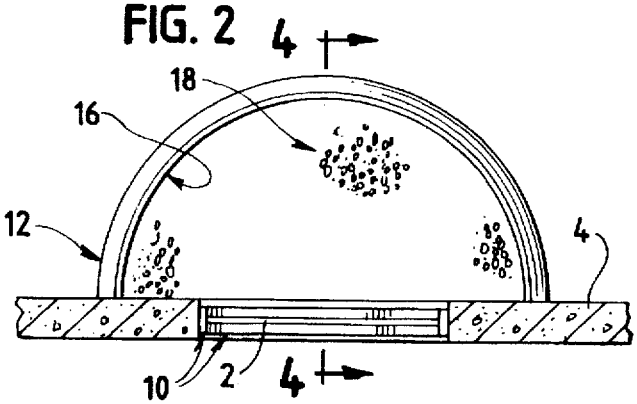
FIG. 2 is a top plan view taken along the line 2—2 of FIG. 1 showing a window well liner having at least one primary surface that is reflective facing generally toward the window to reflect light rays in the direction of the window.

The preferred embodiments depicted in the drawing include a light collection and distribution apparatus 1 for use with an exterior window well 5 that comprises a window well liner 12 having a number of original reflective surfaces and other means for increasing light passage through the building wall 4 which are designed to increase the amount of light rays 3 passing through the below grade window 2 and into the basement space.

Figure 4:
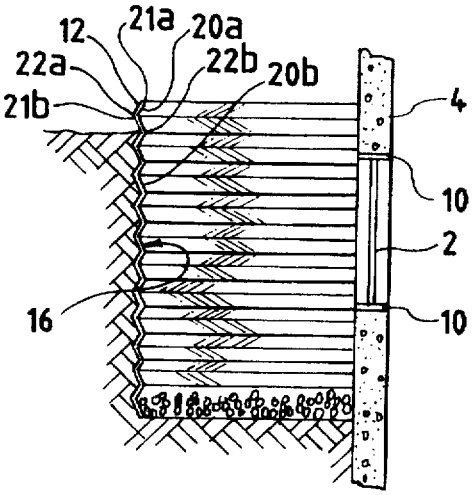
FIG. 4 is a side elevation view taken along the line 3—3 of FIG. 2 showing the window well liner is corrugated wherein the at least one primary surface has a plurality of adjacent generally horizontal band sets, each of said band sets comprises a downwardly reflecting band having an upper edge and a lower edge, and an upwardly reflecting band having an upper edge and a lower edge, and the lower edge of each of the bands of a band set being in contact with the upper edge of an adjacent band.
Figure 5:
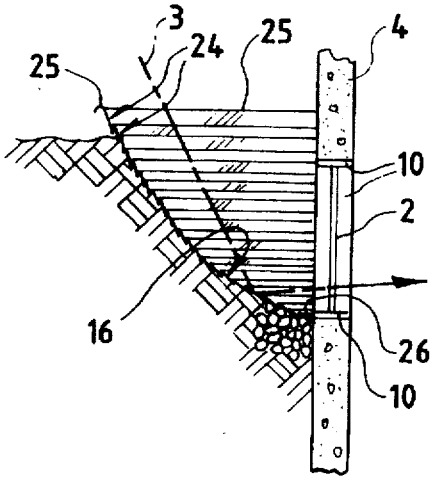
FIG. 5 is a side elevation view of a preferred embodiment of the window well liner wherein the at least one primary surface has a plurality of steps, each of said steps having an included angle of incidence relative to a vertical plane that increases from a top edge of the liner to a bottom edge of the liner.
Figure 6:
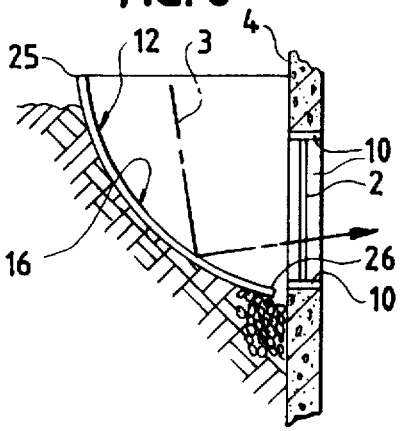
FIG. 6 is a side elevation view of a preferred embodiment of the window well liner wherein the mean horizontal distance between the at least one primary surface and the building wall decreases from a top edge of the liner to the bottom edge of the liner.
Figure 10:
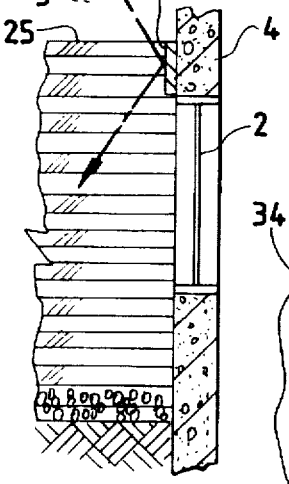
FIG. 10 is a fragmentary side elevation view taken along the line 10—10 of FIG. 9 showing the building wall and reflective framework.

The liner 12 is disposed in operative association with the window well 5 and has a bottom edge 26 that extends below grade 8. As best shown in FIGS. 4, 5, and 6, the at least one primary surface 16 may be skewed from a vertical plane. As illustrated in FIG. 10, a reflective panel 32 of a preferred embodiment of the apparatus of the invention is mounted on the building wall 4 above the window 2 to reflect light rays 3 away from the building wall 4. At least a portion of the first reflective panel 32 may be skewed relative to the building wall.

Figure 7:
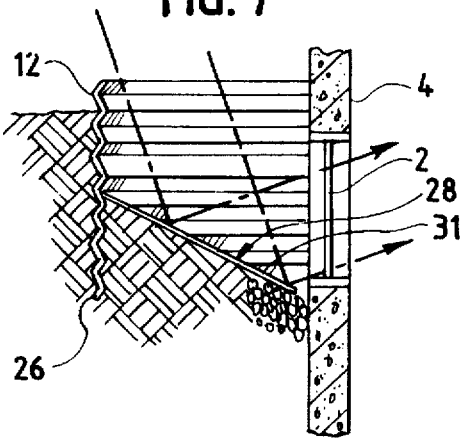
FIG. 7 is a side elevation view of a preferred embodiment of the light collection and distribution apparatus comprising at least one pad arranged proximate to the bottom edge of the liner having at least one generally upwardly facing reflective surface.
Figure 11:
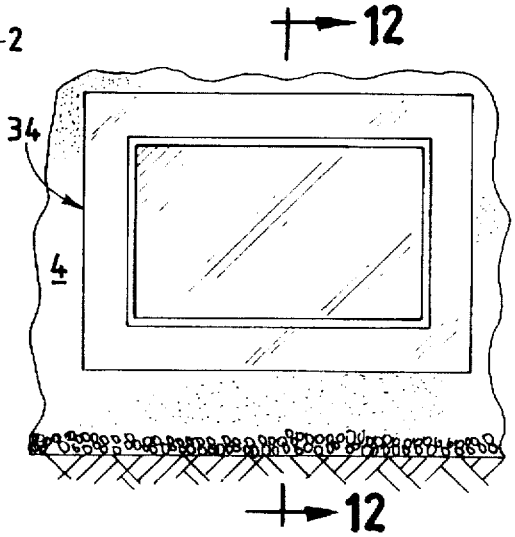
FIG. 11 is a fragmentary front elevation view of the building wall showing the reflective framework mounted on the building wall surrounding the window to reflect light rays away from the building wall.
Figure 12:
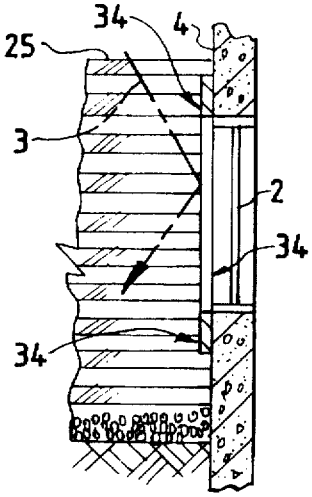
FIG. 12 is a fragmentary side elevation view taken along the line 12—12 of FIG. 11 showing the building wall and surrounding reflective framework.

Referring to FIG. 7, a side elevation view of a preferred embodiment of the light collection and distribution apparatus comprising at least one pad 28 arranged proximate to the bottom edge 26 of the liner 12 with at least one generally upwardly facing reflective surface 31 is shown. A reflective framework 34, as shown in FIGS. 11 and 12, is mounted on the building wall around at least a portion of the window 2 to reflect light rays away from the building wall 4.

Figure 14:
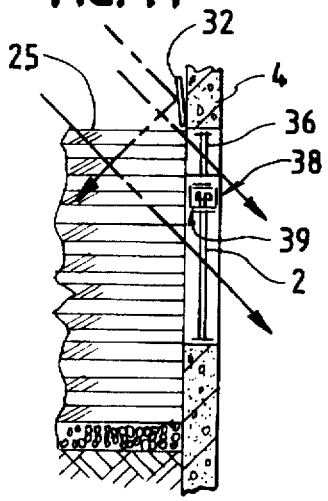
FIG. 14 is a fragmentary side elevation view taken along the line 14—14 of FIG. 13 showing the reflective framework being skewed relative to the building wall.

Means for increasing light passage through the building wall may further comprise at least one of a transom 36 disposed in the building wall 4 above the window 2, where the transom 36 is supported by a crossbar 38 secured to the building wall 4 separating the transom 36 from the window 2, the crossbar 38 in a preferred mode would have rebar 39 along its length to stabilize the building wall 4, as shown in FIG. 14; at least one of a first reflective surface 40 disposed on a bottom exterior sill 42 of the window 2 and a second reflective surface 44 disposed on a bottom interior sill 46 of the window, where the at least one of a first reflective surface 40 and a second reflective surface 44 are arranged to reflect light rays 3 through the window 2; and a plurality of reflectors 48 disposed on at least a side portion of the frame 10, where the reflectors 48 are arranged to reflect light rays through the window 2.

Without departing from the generality of the invention disclosed herein, it could be further applied to above grade windows, particularly those having obscured views of the sun.

The discussion that follows, without limiting the scope of the invention, will refer to the invention as depicted in the drawing, showing an apparatus that is adapted for use with an exterior window well disposed in operative association with a building wall that has an opening with a window extending below grade.

Figure 1:
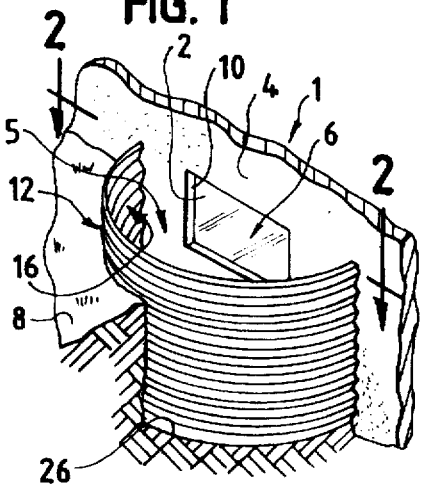
FIG. 1 is a perspective view of a first preferred embodiment of the light collection and distribution apparatus used with an exterior window well that is disposed in operative association with a building wall that has an opening with a window extending below grade.

Referring to FIG. 1 presenting a first preferred embodiment of the invention, a light collection and distribution apparatus 1, for use with an exterior window well 5 disposed in operative association with a building wall 4 that has an opening 6 with a window 2 extending below grade 8 supported by a frame 10 comprises a window well liner 12 disposed in operative association with the window well and having a bottom edge 26 that extends below grade, the window well liner having at least one primary surface 16 that is reflective, and the at least one primary surface facing generally toward the window to reflect light rays in the direction of the window 2.

The liner 12 would most preferably be made of galvanized steel having generally the characteristics of prior art commercially available window well liners. The at least one primary surface may be highly polished so that it readily reflects the sun. Alternately, the at least one primary surface may consist of a reflective coating applied by dipping or spraying. The other reflective surface of the instant invention may be similarly produced. Moreover, the at least one primary surface 16 may be skewed relative to the building wall 4.

In FIG. 6, a preferred embodiment of the invention is introduced having a liner 12 with the mean horizontal distance between the at least one primary surface 16 and the building wall 4 decreases from a top edge 25 of the liner to a bottom edge 26 of the liner.

In a preferred embodiment of the invention shown in FIG. 5, the at least one primary surface 16 has a plurality of steps 24, each of the steps having an included angle of incidence relative to a vertical plane that increases from a top edge 25 of the liner to a bottom edge 26 of the liner 12.

As best illustrated in FIG. 4, a preferred embodiment of the invention is shown wherein the at least one primary surface is corrugated with alternating downwardly and upwardly reflecting bands.

Referring to FIGS. 4, and 19–22 the at least one primary surface 16 has a plurality of adjacent generally horizontal band sets, each of the band sets comprises a downwardly reflecting band 20*a* having an upper edge 21*a* and a lower edge 22*a*, and an upwardly reflecting band 20*b* having an upper edge 21*b* and a lower edge 22*b*, and the lower edge (22*a* and 22*b*, respectively) of each of the bands of a band set being in contact with the upper edge (21*a* and 21*b*, respectively) of an adjacent band.

Each of the bands may have a constant pitch angle relative to a vertical plane. The pitch angle is in the range of 0 to 45 degrees. In a preferred embodiment, the pitch angle is approximately 28 degrees.

Figure 9:
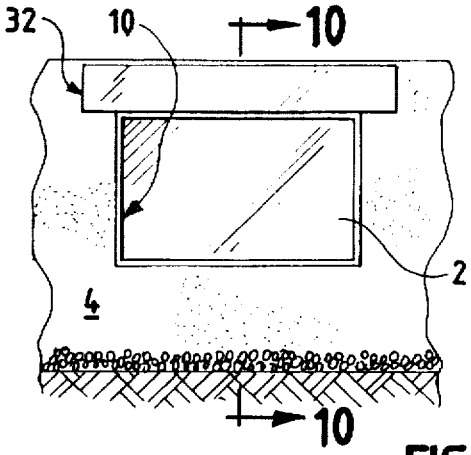
FIG. 9 is a fragmentary front elevation view of the building wall showing a reflective framework mounted on the building wall around at least a portion of the window to reflect light rays away from the building wall.

In another preferred embodiment of the invention shown in FIGS. 9 and 10, the light collection and distribution apparatus further comprises a reflective panel 32 mounted on the building wall 4 adjacent to the window 2 to reflect light rays 3 away from the building wall 4. Additionally, the invention may have a reflective panel 32 being mounted on the building wall above the window to reflect light rays away from the building wall.

Referring to FIGS. 14 and 23–25, a portion of the first reflective panel may be skewed relative to the building wall. The relative angle between the skewed of the portion of the first reflective panel 32 and the building wall 4 is in the range of 0 to 90 degrees, and preferably at approximately 45 degrees.

Figure 3:
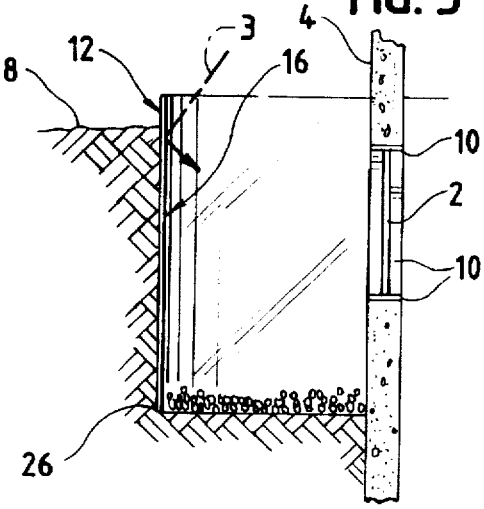
FIG. 3 is a side elevation view of the light collection and distribution apparatus showing the window well liner having a smooth reflective surface.

Referring now to FIG. 3, a further refinement of the preferred embodiment of the invention is shown wherein the liner 12 has a portion of cylinder shape and the reflective surface 16 is concave.

Figure 8:
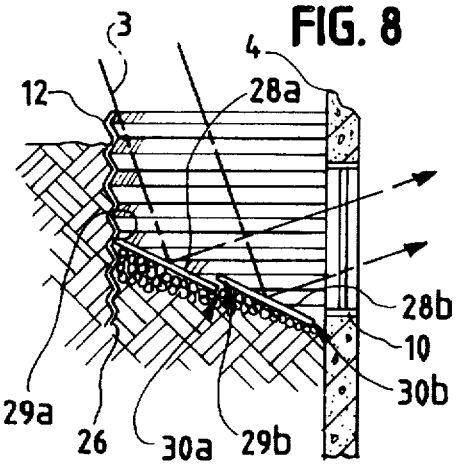
FIG. 8 is a side elevation view of a preferred embodiment of the at least one pad comprising a first pad and a second pad, each of said first pad and said second pad having a first edge and an oppositely disposed second edge, said first edge of the first pad arranged proximate to the bottom edge of the liner, the second edge of the first pad arranged proximate to the first edge of the second pad, and the second edge of the second pad arranged proximate to the bottom edge of the frame.

As shown in FIG. 7, the first preferred embodiment of the light collection and distribution apparatus of this important invention may further comprise at least one pad 28 arranged proximate to the bottom edge 26 of the liner 12 having at least one generally upwardly facing reflective surface 31. Furthermore, as shown in FIG. 8, the at least one pad may comprises a first pad 28a and a second pad 28b, each of the first pad and the second pad having a first edge and an oppositely disposed second edge, the first edge 29a of the first pad 28a is arranged proximate to the bottom edge 26 of the liner 12, the second edge 30a of the first pad 28a is arranged proximate to the first edge 29b of the second pad 28b, and the second edge 30b of the second pad 28b is arranged proximate to the bottom edge of the frame 10. Additionally, each of the at least one pad may be sloped relative to a horizontal plane passing through the bottom edge of the frame 10. The angle of the sloped at least one pad is in the range of 0 to 40 degrees relative to a horizontal plane, preferably, the angle of the sloped first pad 28a is approximately 35 degrees and the angle of the sloped second pad 28b is approximately 28 degrees.

As presented in FIGS. 11 and 12, the first preferred embodiment of the light collection and distribution apparatus of this important invention may further comprise a reflective framework 34 mounted on the building wall 4 around at least a portion of the window 2 to reflect light rays 3 away from the building wall. The reflective framework 34 may be skewed relative to the building wall 4.

Figure 13:
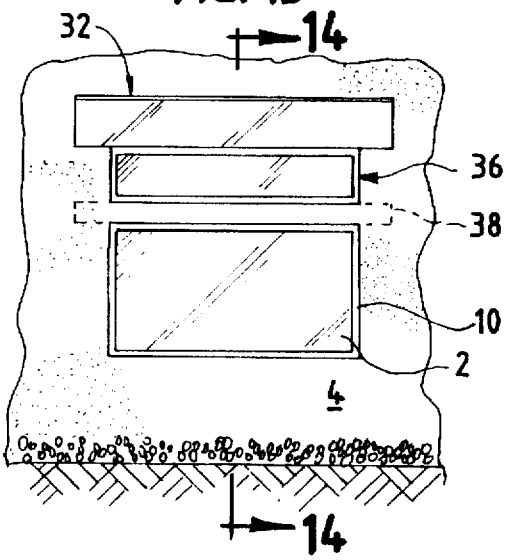
FIG. 13 is a fragmentary front elevation view of means for increasing light comprises a transom that is supported by a crossbar that is secured to the building wall and a reflective panel being mounted on the building wall adjacent to the transom to reflect light rays away from the building wall.

Moreover, as best viewed in FIGS. 13–18, the embodiments of the light collection and distribution apparatus of this invention may comprise means for increasing light passage through the building wall. Referring to FIG. 13, the means for increasing light may include a transom 36 that is supported by a crossbar 38 secured to the building wall 4 which separates the transom from the window 2. The transom 36 is disposed in the building wall above the window.

The means for increasing light may further comprise a reflective panel 32 mounted on the building wall 4 adjacent to the transom 36 to reflect light rays away from the building wall. The reflective panel 32 may be skewed relative to the building wall, as shown in FIG. 14, to reflect light rays downwardly away from the building wall to which it is mounted.

Figure 15:
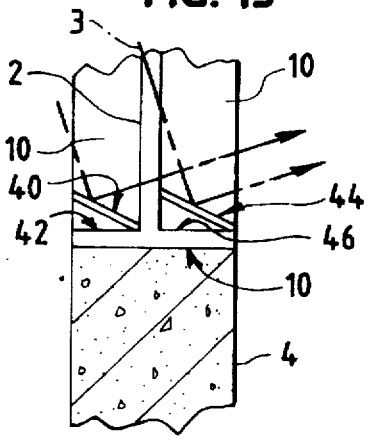
FIG. 15 is a fragmentary enlarged side elevation view of the window sill of the frame showing a first reflective surface disposed on a bottom exterior sill of the window and a second reflective surface disposed on a bottom interior sill of the window.
Figure 16:
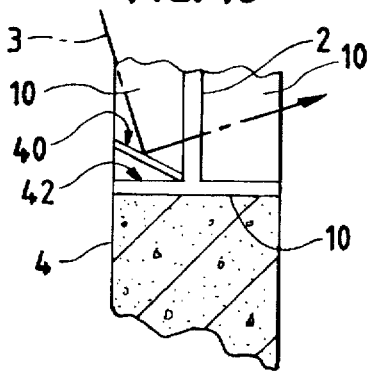
FIG. 16 is a fragmentary enlarged side elevation view of the window sill of the frame showing a first reflective surface disposed on a bottom exterior sill of the window.
Figure 17:
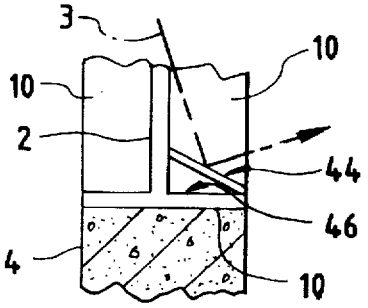
FIG. 17 is a fragmentary enlarged side elevation view of the window sill of the frame showing a second reflective surface disposed on a bottom interior sill of the window.

Referring to FIGS. 15–17 of the drawing, the means for increasing light comprises at least one of a first reflective surface 40 disposed on a bottom exterior sill 42 of the window 2 and a second reflective surface 44 disposed on a bottom interior sill 46 of the window, whereby light rays 3 are reflected through the window 2.

Figure 18:
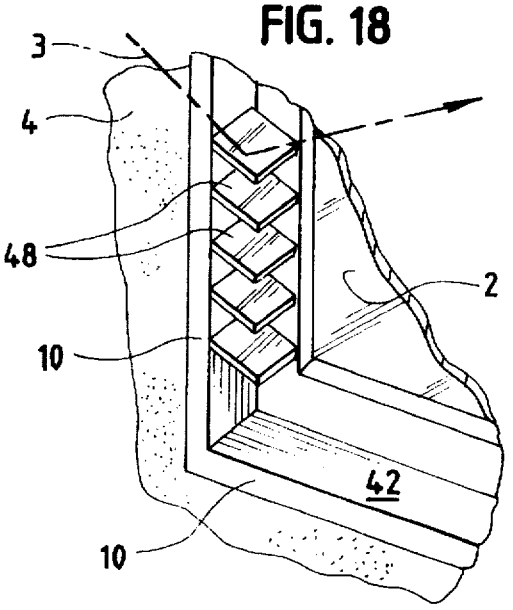
FIG. 18 is a fragmentary perspective view of a preferred embodiment of the light collection and distribution apparatus showing a plurality of reflectors disposed on at least a side portion of the frame.
Figure 19:
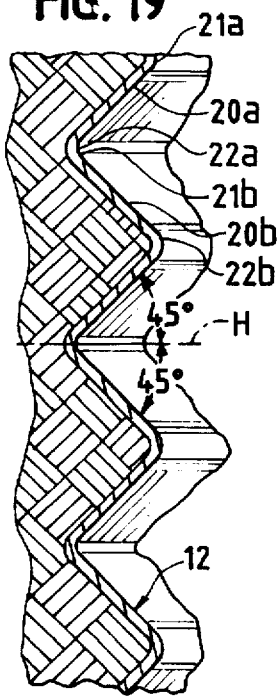
FIG. 19 is a fragmentary side elevation of the preferred embodiment of the light collection and distribution apparatus showing the window well liner with a plurality of adjacent hand sets, each having a pitch angle of 45°.
Figure 20:
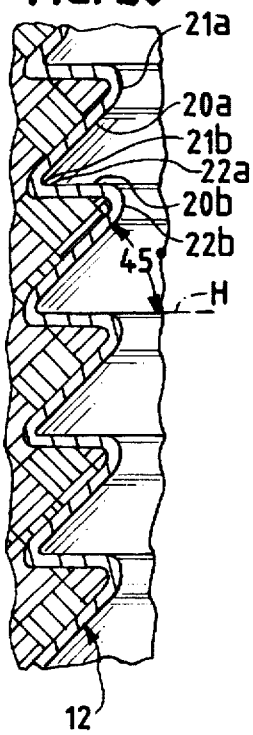
FIG. 20 is a fragmentary side elevation of the preferred embodiment of the light collection and distribution apparatus showing the window well liner with a plurality of adjacent hand sets, showing the downwardly reflecting bands at a pitch angle of 45° and the upwardly reflecting bands at the pitch angle of 0°.
Figure 21:
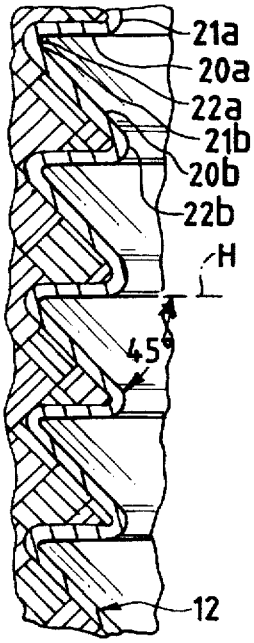
FIG. 21 is a fragmentary side elevation of the preferred embodiment of the light collection and distribution apparatus showing the window well liner with a plurality of adjacent hand sets, showing the downwardly reflecting band at a pitch angle of 0° and the upwardly reflecting band at the pitch angle of 45°.
Figure 22:
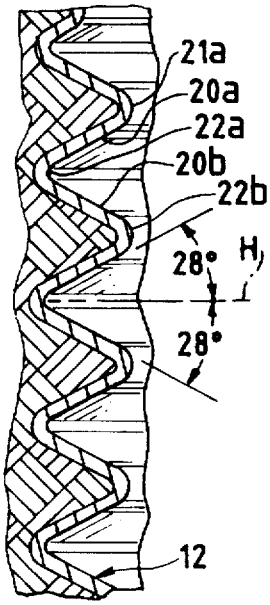
FIG. 22 is a fragmentary side elevation of the preferred embodiment of the light collection and distribution apparatus showing the window well liner with a plurality of adjacent hand sets, each having a pitch angle of 28°.
Figure 23:
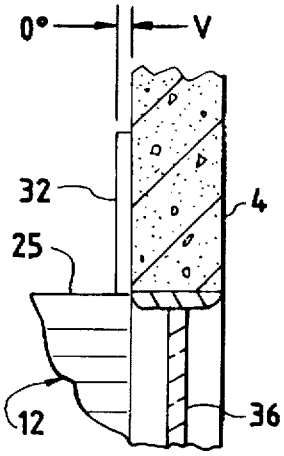
FIG. 23 is a fragmentary side elevation view showing the reflective framework with the relative angle between the at least a portion of said reflected panel in said building of 0°.
Figure 24:
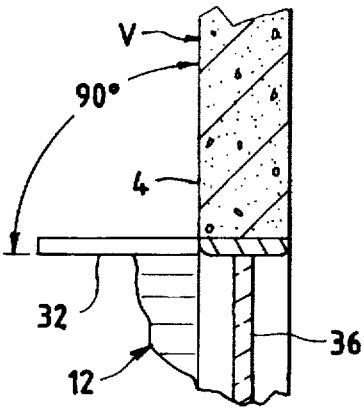
FIG. 24 is a fragmentary side elevation view showing the reflective framework with the relative angle between the at least a portion of said reflected panel in said building of 90°.
Figure 25:
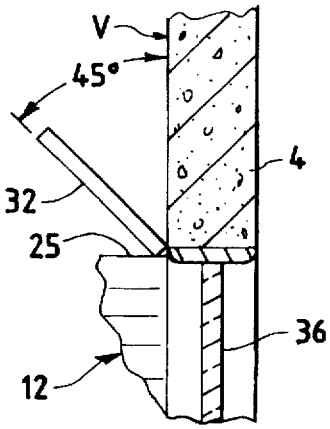
FIG. 25 is a fragmentary side elevation view showing the reflective framework with the relative angle between the at least a portion of said reflected panel in said building of 45°.

Moreover, the means for increasing light may contain a plurality of reflectors 48 disposed on at least a side portion of the frame 10, as shown in FIG. 18. The reflectors 48 are arranged to reflect light rays through the window. In a preferred mode, each reflector 48 will be flat, square in shape with edges having a length of approximately 3 inches, and each reflector will be skewed relative to a plane parallel to the window 2 and to a horizontal plane.

Defining the term vertex to be the meeting of two edges of the reflector, in a preferred mode, a first vertex of one of the reflectors 48 is disposed adjacent to a side portion of the frame 10 of the window 2 with a second vertex which is adjacent to the first vertex disposed below a horizontal plane containing the first vertex and a third vertex which is adjacent to the first vertex disposed above the horizontal plane containing the first vertex. In the preferred mode the second vertex is approximately 1.375 inches, measured horizontally from the side portion of the frame of the window to which the first vertex of the reflector is adjacently disposed, and the third vertex is approximately 1.0 inches, measured horizontally from the side portion of the frame of the window to which the first vertex of the reflector is adjacently disposed. Furthermore, in the preferred mode all of the reflectors disposed adjacent to a particular side portion of the frame of the window are parallel, as shown in FIG. 18.

In a preferred embodiment of the light collection and distribution apparatus 1 for use with an exterior window well 5 disposed in operative association with a building wall 4 that has an opening 6 with a window 2 extending below grade 8 supported by a frame 10 comprising means for increasing light passage through the building wall has a transom supported by a crossbar that is secured to the building wall above the frame separating the transom from the window, as depicted in FIG. 13 of the drawing.

As best shown in FIG. 15, 16, and 17, a preferred embodiment of the light collection and distribution apparatus for use with an exterior window well disposed in operative association with a building wall that has an opening with a window extending below grade supported by a frame comprising means for increasing light passage through the building wall has at least one of a first reflective surface disposed on a bottom exterior sill of the window (FIG. 16) and a second reflective surface disposed on a bottom interior sill of the window (FIG. 17), whereby light rays are reflected through the window.

In another preferred embodiment of the light collection and distribution apparatus for use with an exterior window well disposed in operative association with a building wall that has an opening with a window extending below grade supported by a frame comprising means for increasing light passage through the building wall having a plurality of reflectors disposed along at least a side portion of the frame, the reflectors being arranged to reflect light rays through the window, as illustrated in FIG. 18. Additionally, each of the reflectors lies in one of a series of parallel reflector planes, each of the reflector planes is offset relative to a window plane in which the window is disposed, the window plane lying along the x-y axes in a rectangular coordinate system with the z axis perpendicular to the window plane; each of the reflector planes lying along a rotated rectangular coordinate system with a line perpendicular to the reflector plane that is skewed relative to each of the x, y, and z axes of the rectangular coordinate system.

In a further preferred embodiment of the light collection and distribution apparatus for use with an exterior window well disposed in operative association with a building wall that has an opening with a window extending below grade supported by a frame comprising means for increasing light passage through the building wall comprising a transom 36 disposed in the building wall 4 above the window 2, wherein the transom being supported by a crossbar 38 secured to the building wall which separates the transom from the window (The crossbar 38 may employ reinforcing steel bars (rebar) 39 to stabilize the building wall and the position of the transom 36.); at least one of a first reflective surface 40 disposed on a bottom exterior sill 42 of the window 2 and a second reflective surface 44 disposed on a bottom interior sill 46 of the window, the at least one of a first reflective surface and a second reflective surface being arranged to reflect light rays through the window; and a plurality of reflectors 48 disposed on at least a side portion of the frame 10, wherein the reflectors are arranged to reflect light rays through the window.

Referring again to FIGS. 13 and 14, a preferred embodiment of the light collection and distribution apparatus comprises means for increasing light passage through the building wall having a transom 36 disposed in the building wall 4 above the window 2, wherein the transom is supported by a crossbar 38 secured to the building wall which separates the transom from the window; and at least one of a first reflective surface 40 disposed on a bottom exterior sill 42 of the window 2 and a second reflective surface 44 disposed on a bottom interior sill 46 of the window, wherein the at least one of a first reflective surface and a second reflective surface being arranged to reflect light rays through the window.

In another preferred embodiment of the light collection and distribution apparatus, the means for increasing light passage through the building wall comprises a transom 36 disposed in the building wall 4 above the window 2, wherein the transom is supported by a crossbar 38 secured to the building wall which separates the transom from the window; and a plurality of reflectors 48 are disposed on at least a side portion of the frame 10, wherein the reflectors are arranged to reflect light rays through the window.

In yet another preferred embodiment of the light collection and distribution apparatus the means for increasing light passage through the building wall comprises at least one of a first reflective surface 40 disposed on a bottom exterior sill 42 of the window, as shown in FIG. 16, and a second reflective surface 44 disposed on a bottom interior sill 46 of the window, wherein the at least one of a first reflective surface and a second reflective surface are arranged to reflect light rays through the window; and a plurality of reflectors 48, as shown in FIG. 18, are disposed on at least a side portion of the frame, the reflectors being arranged to reflect light rays through the window.

While this invention has been described in connection with the best mode presently contemplated by the inventor for carrying out his invention, the preferred embodiments described and shown are for purposes of illustration only, and are not to be construed as constituting any limitations of the invention. Clearly, the reflective surfaces revealed herein could be made angularly adjustable to enhance efficiency and adapt the apparatus to specific environments. Other modifications will also be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed as being new and desired to be protected by Letters Patent of the United States is a follows:

1. A light collection and distribution apparatus for use with an exterior window well disposed in operative association with a building wall that has an opening with a window extending below grade supported by a frame comprising:

a. a window well liner having at least one primary surface that is reflective, said at least one primary surface facing generally toward the window to reflect light rays in the direction of said window, said liner being at least partially disposed in the window well and having a bottom edge that extends below grade, said at least one primary surface being skewed from a vertical plane;

b. a reflective panel being mounted on the building wall above the window to reflect light rays away from the building wall, at least a portion of said first reflective panel being skewed relative to said building wall;

c. at least one pad arranged proximate to the bottom edge of the liner having at least one generally upwardly facing reflective surface;

d. a reflective framework mounted on the building wall around at least a portion of the window to reflect light rays away from the building wall; and e. means for increasing light passage through the building wall comprising at least one of:

(1) a transom disposed in the building wall above the window, said transom being supported by a crossbar secured to the building wall which separates the transom from the window;

(2) at least one of a first reflective surface disposed on a bottom exterior sill of the window and a second reflective surface disposed on a bottom interior sill of the window, said at least one of a first reflective surface and a second reflective surface being arranged to reflect light rays through the window; and (3) a plurality of reflectors disposed on at least a side portion of the frame, said reflectors being arranged to reflect light rays through the window.

2. A light collection and distribution apparatus for use with an exterior window well disposed in operative association with a building wall that has an opening with a window extending below grade supported by a frame comprising a window well liner at least partially disposed in the window well and having a bottom edge that extends below grade, said window well liner having at least one primary surface that is reflective, and said at least one primary surface facing generally toward the window to reflect light rays in the direction of said window.

3. The light collection and distribution apparatus of claim 2 wherein said at least one primary surface is skewed relative to said building wall.

4. The light collection and distribution apparatus of claim 2 wherein the mean horizontal distance between the at least one primary surface and the building wall decreases from a top edge of the liner to the bottom edge of the liner.

5. The light collection and distribution apparatus of claim 2 wherein the at least one primary surface has a plurality of steps, each of said steps having an included angle of incidence relative to a vertical plane that increases from a top edge of the liner to a bottom edge of the liner.

6. The light collection and distribution apparatus of claim 2 wherein the at least one primary surface has a plurality of adjacent generally horizontal band sets, each of said band sets comprises a downwardly reflecting band having an upper edge and a lower edge, and an upwardly reflecting band having an upper edge and a lower edge, and the lower edge of each of the bands of a band set being in contact with the upper edge of an adjacent band.

7. The light collection and distribution apparatus of claim 6 wherein each of the bands has a constant pitch angle relative to a vertical plane.

8. The light collection and distribution apparatus of claim 7 wherein the pitch angle is in the range of 0 to 45 degrees.

9. The light collection and distribution apparatus of claim 8 wherein the pitch angle is approximately 28 degrees.

10. The light collection and distribution apparatus of claim 2 further comprising a reflective panel being mounted on the building wall adjacent to the window to reflect light rays away from the building wall.

11. The light collection and distribution apparatus of claim 2 further comprising a reflective panel being mounted on the building wall above the window to reflect light rays away from the building wall.

12. The light collection and distribution apparatus of claim 10 wherein said first reflective panel is skewed relative to said building wall.

13. The light collection and distribution apparatus of claim 12 wherein the relative angle between said first reflective panel and said building wall is in the range of 0 to 90 degrees.

14. The light collection and distribution apparatus of claim 12 wherein the relative angle between said first reflective panel and said building wall is approximately 45 degrees.

15. The light collection and distribution apparatus of claim 2 wherein the liner has the shape of a portion of cylinder.

16. The light collection and distribution apparatus of claim 2 further comprising at least one pad arranged proximate to the bottom edge of the liner having at least one generally upwardly facing reflective surface.

17. The light collection and distribution apparatus of claim 2 wherein said at least one pad comprises a first pad and a second pad, each of said first pad and said second pad having a first edge and an oppositely disposed second edge, said first edge of the first pad arranged proximate to the bottom edge of the liner, the second edge of the first pad arranged proximate to the first edge of the second pad, and the second edge of the second pad arranged proximate to the bottom edge of the frame.

18. The light collection and distribution apparatus of claim 17 wherein each of said at least one pad is sloped relative to a horizontal plane passing through the bottom edge of the frame.

19. The light collection and distribution apparatus of claim 18 wherein the slope of the at least one pad relative to the horizontal plane passing through the bottom edge of the frame is in the range of 0 to 40 degrees.

20. The light collection and distribution apparatus of claim 18 wherein the slope of the first pad relative to the horizontal plane passing through the bottom edge of the frame is approximately 35 degrees and the slope of the second pad relative to the horizontal plane passing through the bottom edge of the frame is approximately 28 degrees.

21. The light collection and distribution apparatus of claim 2 further comprising a reflective framework mounted on the building wall around at least a portion of the window to reflect light rays away from the building wall.

22. The light collection and distribution apparatus of claim 21 wherein the reflective framework is skewed relative to the building wall.

23. The light collection and distribution apparatus of claim 2 further comprising means for increasing light passage through the building wall.

24. The light collection and distribution apparatus of claim 23 wherein the means for increasing light comprises a transom that is supported by a crossbar that is secured to the building wall which separates the transom from the window is disposed in the building wall above the window.

25. The light collection and distribution apparatus of claim 24 wherein the means for increasing light further comprises a reflective panel being mounted on the building wall adjacent to the transom to reflect light rays away from the building wall.

26. The light collection and distribution apparatus of claim 25 wherein the reflective panel is skewed relative to the building wall to reflect light rays downwardly away from the building wall to which it is mounted.

27. The light collection and distribution apparatus of claim 23 wherein the means for increasing light comprises at least one of a first reflective surface disposed on a bottom exterior sill of the window and a second reflective surface disposed on a bottom interior sill of the window, whereby light rays are reflected through the window.

28. The light collection and distribution apparatus of claim 23 wherein the means for increasing light comprises a plurality of reflectors disposed on at least a side portion of the frame, said reflectors being arranged to reflect light rays through the window.

29. The light collection and distribution apparatus of claim 2 wherein the at least one primary surface is corrugated with alternating downwardly and upwardly reflecting bands.

30. A light collection and distribution apparatus for use with an exterior window well disposed in operative association with a building wall that has an opening with a window extending below grade supported by a frame comprising means for increasing light passage through the building wall having a transom supported by a crossbar that is secured to the building wall above the frame separating the transom from the window.

31. A light collection and distribution apparatus for use with an exterior window well disposed in operative association with a building wall that has an opening with a window extending below grade supported by a frame comprising means for increasing light passage through the building wall having at least one of a first reflective surface disposed on a bottom exterior sill of the window and a second reflective surface disposed on a bottom interior sill of the window, whereby light rays are reflected through the window.

32. A light collection and distribution apparatus for use with an exterior window well disposed in operative association with a building wall that has an opening with a window extending below grade supported by a frame comprising means for increasing light passage through the building wall having a plurality of reflectors disposed along at least a side portion of the frame, said reflectors being arranged to reflect light rays through the window.

33. The light collection and distribution apparatus of claim 32 wherein each of said reflectors lies in one of a series of parallel reflector planes, each of said reflector planes is offset relative to a window plane in which the window is disposed, said window plane lying along the x-y axes in a rectangular coordinate system with the z axis perpendicular to said window plane;

each of said reflector planes having a line perpendicular to said reflector plane that is skewed relative to each of the x, y, and z axes of the rectangular coordinate system.

34. A light collection and distribution apparatus for use with an exterior window well disposed in operative association with a building wall that has an opening with a window extending below grade supported by a frame comprising means for increasing light passage through the building wall comprising:

(1) a transom disposed in the building wall above the window, said transom being supported by a crossbar secured to the building wall which separates the transom from the window;

(2) at least one of a first reflective surface disposed on a bottom exterior sill of the window and a second reflective surface disposed on a bottom interior sill of the window, said at least one of a first reflective surface and a second reflective surface being arranged to reflect light rays through the window; and (3) a plurality of reflectors disposed on at least a side portion of the frame, said reflectors being arranged to reflect light rays through the window.

35. A light collection and distribution apparatus for use with an exterior window well disposed in operative association with a building wall that has an opening with a window extending below grade supported by a frame comprising means for increasing light passage through the building wall comprising:

(1) a transom disposed in the building wall above the window, said transom being supported by a crossbar secured to the building wall which separates the transom from the window; and (2) at least one of a first reflective surface disposed on a bottom exterior sill of the window and a second reflective surface disposed on a bottom interior sill of the window, said at least one of a first reflective surface and a second reflective surface being arranged to reflect light rays through the window.

36. A light collection and distribution apparatus for use with an exterior window well disposed in operative association with a building wall that has an opening with a window extending below grade supported by a frame comprising means for increasing light passage through the building wall comprising:

(1) a transom disposed in the building wall above the window, said transom being supported by a crossbar secured to the building wall which separates the transom from the window; and (2) a plurality of reflectors disposed on at least a side portion of the frame, said reflectors being arranged to reflect light rays through the window.

37. A light collection and distribution apparatus for use with an exterior window well disposed in operative association with a building wall that has an opening with a window extending below grade supported by a frame comprising means for increasing light passage through the building wall comprising:

(1) at least one of a first reflective surface disposed on a bottom exterior sill of the window and a second reflective surface disposed on a bottom interior sill of the window, said at least one of a first reflective surface and a second reflective surface being arranged to reflect light rays through the window; and (2) a plurality of reflectors disposed on at least a side portion of the frame, said reflectors being arranged to reflect light rays through the window.

* * * * *